US009126734B2

(12) United States Patent
von Glasow

(10) Patent No.: US 9,126,734 B2
(45) Date of Patent: Sep. 8, 2015

(54) SELF VENTING STEAM VALVE FOR FLEXIBLE PACKAGING BAGS AND POUCHES USED IN COOKING OF FOODS

(75) Inventor: Christian von Glasow, Saint-Lambert (CA)

(73) Assignee: Ultraperf Technologies Inc., Saint-Jean-sur-Richelieu (CA)

( * ) Notice: Subject to any disclaimer, the term of this patent is extended or adjusted under 35 U.S.C. 154(b) by 0 days.

(21) Appl. No.: 13/982,960

(22) PCT Filed: Jan. 4, 2012

(86) PCT No.: PCT/CA2012/000014
§ 371 (c)(1),
(2), (4) Date: Oct. 13, 2013

(87) PCT Pub. No.: WO2012/103630
PCT Pub. Date: Aug. 9, 2012

(65) Prior Publication Data

US 2014/0027446 A1 Jan. 30, 2014

Related U.S. Application Data

(60) Provisional application No. 61/437,905, filed on Jan. 31, 2011.

(51) Int. Cl.
*B65D 77/38* (2006.01)
*B65D 81/34* (2006.01)
*B65D 77/22* (2006.01)

(52) U.S. Cl.
CPC ..... *B65D 77/225* (2013.01); *B65D 81/3453* (2013.01); *B65D 81/3461* (2013.01)

(58) Field of Classification Search
CPC .. B65D 25/082; B65D 27/16; B65D 51/1638; B65D 77/225; B65D 81/3461
USPC ..... 219/725, 731, 733, 734, 735, 741, 769, 219/770, 771, 727; 426/113, 114, 118, 122, 426/123
See application file for complete search history.

(56) References Cited

U.S. PATENT DOCUMENTS 3,311,287 A * 3/1967 Long et al. ..... 383/100
3,432,087 A * 3/1969 Costello ..... 383/103
(Continued)

FOREIGN PATENT DOCUMENTS

EP 683105 11/1995
EP 795482 A2 * 9/1997
(Continued)

OTHER PUBLICATIONS

International Search Report mailed Apr. 16, 2012, in corresponding PCT Application No. PCT/CA2012/000014.
(Continued)

*Primary Examiner* — Dana Ross
*Assistant Examiner* — John J Norton
(74) *Attorney, Agent, or Firm* — Mintz Levin Cohn Ferris Glovsky and Popeo, P.C.; Steven M. Jensen

(57) ABSTRACT

The present document describes a cooking container for cooking foodstuff comprising: an edge having a seal separating the interior from the exterior of the cooking container; a steam valve formed in the seal, the steam valve comprising: a pressure accumulating portion; a pressure controlling portion; and a breakable seal between the pressure accumulating portion and the pressure controlling portion; whereby the breakable seal is breakable under an increase in pressure in the pressure accumulating portion during cooking thereby forming a gap/passage in the seal and permitting controlled evacuation of pressure from the interior of the cooking container through the gap/passage to the exterior, the pressure controlling portion restricting the evacuation of pressure relative to the pressure accumulating portion after the breakable seal is broken.

17 Claims, 6 Drawing Sheets

(56) References Cited

U.S. PATENT DOCUMENTS

| | | | | |
|---|---|---|---|---|
| 3,502,487 | A * | 3/1970 | Byrd | 426/106 |
| 3,637,132 | A * | 1/1972 | Gray | 383/100 |
| 3,937,396 | A * | 2/1976 | Schneider | 383/94 |
| 4,890,744 | A * | 1/1990 | Lane et al. | 222/107 |
| 5,419,638 | A * | 5/1995 | Jamison | 383/100 |
| 5,989,608 | A * | 11/1999 | Mizuno | 426/113 |
| 6,121,597 | A * | 9/2000 | Igota et al. | 219/725 |
| 2007/0071855 | A1* | 3/2007 | Kanzaki | 426/107 |
| 2007/0110856 | A1* | 5/2007 | Kanzaki | 426/107 |
| 2010/0266732 | A1* | 10/2010 | Thomas et al. | 426/113 |
| 2011/0100983 | A1* | 5/2011 | Han | 219/725 |
| 2011/0100984 | A1* | 5/2011 | Han | 219/725 |

FOREIGN PATENT DOCUMENTS

| | | | |
|---|---|---|---|
| EP | 2003071 | A2 * | 12/2008 |
| EP | 2246271 | | 11/2010 |
| GB | 2367033 | | 3/2002 |

OTHER PUBLICATIONS

Written Opinion mailed Apr. 16, 2012, in corresponding PCT Application No. PCT/CA2012/000014.

* cited by examiner

SELF VENTING STEAM VALVE FOR FLEXIBLE PACKAGING BAGS AND POUCHES USED IN COOKING OF FOODS

CROSS-REFERENCE TO RELATED APPLICATIONS

This application is the 35 U.S.C. §371 National Stage of PCT Application No. PCT/CA 2012/000014, filed Jan. 4, 2012, which claims from the benefit of and priority to U.S. provisional pat. application no. 61/437,905 filed on Jan. 31, 2011. The contents of each of the foregoing applications are incorporated herein by reference in their entirety.

BACKGROUND

This description relates to a bag or pouch for storing foodstuff. More particularly, the present description relates to polymer-based bags or pouches adapted to enable the venting of steam pressure during the cooking of foodstuffs stored therein while maintaining a positive pressure inside the package.

The availability of prepared ready to cook foods packaged in microwavable bags and pouches has increased significantly during recent years. Typically the consumer must puncture the bag prior to cooking to allow the steam pressure created during cooking to vent out of the package. Not allowing the steam to escape often results in the package "exploding" which creates a mess in the oven. Food suppliers and processors continually attempt to provide increased convenience to the consumer relating to ease of cooking. The result is a trend towards self venting bags which eliminate the step by the consumer to manually pierce a hole or opening into the bag prior to cooking. The bags contain a vent system incorporated into the film. There are various patents in this domain. One system is to perforate a given number of very small holes into the bag, the size and number determined by the foodstuff to be packaged and the corresponding cooking time required. Over the small holes there is placed a thin plastic membrane providing a hermetic seal, but with an adhesive/pressure combination to allow this membrane to dislodge from the primary bag material as the steam pressure builds inside the bag allowing the steam to vent through the small holes at a controlled rate. This system functions well for both fresh and frozen foods and fresh produce, since a controlled atmosphere can be maintained in the package. The drawback with this process is the production equipment set up required to pierce the holes in the quantity required for the foodstuff and the application of the membrane on each package with the correct adhesive/pressure combination to enable release of the membrane relative to the size required to cover any given number of holes. Production speeds are reduced which negatively impact cost.

Another system is the lamination of two polymer films, end to end with a very small space between the two films over which a very thin membrane strip is laminated. The polymer film can be made into a bag or pouch and as steam pressure builds inside the package during cooking the thin membrane strip will rupture at a random point along the length of the strip in the package and allow the steam to vent out of the bag. Maintaining positive pressure inside the package is difficult since this mechanism does not provide for a controlled rate of steam venting. Maintaining positive steam pressure inside a package is desirable since high levels of steam optimize the cooking of the foodstuff and significantly reduces dehydration of the foodstuff. This process works relatively well with fresh and frozen foods, but does not work well for packaging of fresh produce since the thin membrane does not provide a sufficient gas barrier to control the atmosphere inside the package due to excessive gas exchange.

Another venting system available is to micro perforate the entire package with various quantities of holes based on the food stuff to be cooked and the corresponding cook time. This is the least effective system since moisture loss due to freezer burn cannot be controlled in the case of packaging frozen foods, and for the packaging of fresh produce the number of micro perforations required to allow sufficient steam venting does not necessarily correspond to the number of micro perforations required to provide the ideal atmosphere through controlled gas exchange inside the package to maximize product life of most vegetables.

SUMMARY

The present disclosure provides the design and method for a self venting steam valve integrated into the vertical or horizontal seal of a bag or pouch to allow the dissipation of steam that is produced during the cooking of food.

The present disclosure relates to a self venting steam valve integrated into the vertical and horizontal seal of bags and pouches made from flexible packaging for microwave and/or oven cooking of fresh vegetables and/or fresh/frozen foods.

A self venting steam valve integrated into a section of the vertical or horizontal seal area of a bag or pouch, which is achieved by machining the enclosed steam vent design into the seal bars of commercially available bag, pouch or vertical/horizontal form fill seal machines.

The steam produced by microwave or oven cooking escapes when the thin breakable seal is ruptured at a certain temperature, cook time, or pressure, each or combined, which may vary depending on the food item to be cooked. The steam escapes at a rate which is determined by the width of the horizontal opening in the vertical seal, which may be determined by the food item to be cooked and the quality of cook desired.

If it is desirable to maintain higher levels of steam inside the package then a narrower horizontal opening can be machined into the seal bars to reduce the flow of steam escaping from the package. If it is desirable to allow steam to vent faster, the horizontal opening can be widened. In both cases it is desirable to maintain positive pressure inside the package to optimize cooking quality which can be easily achieved by machining the seal bars to obtain a horizontal opening which will achieve this, while maintaining sufficient steam flow exiting the package to eliminate the possibility of the bag or pouch from "exploding" due to excess steam contained in the package and not being able to escape sufficiently fast.

This steam vent design will work with most commercially available heat sealable mono or multilayer polymer films that are considered "microwave able films" that typically withstand elevated cooking temperatures, which would include but are not be limited to polyethylene terephthalate (polyester) and biaxially oriented polypropylene and certain high temperature resistant polyethylene films.

According to an embodiment, there is provided a cooking container for cooking foodstuff comprising an edge having a seal separating the interior from the exterior of the cooking container; a steam valve formed in the seal, the steam valve comprising: a pressure accumulating portion; a pressure controlling portion; and a breakable seal between the pressure accumulating portion and the pressure controlling portion; whereby the breakable seal is breakable under an increase in pressure in the pressure accumulating portion during cooking thereby forming a gap/passage in the seal and permitting controlled evacuation of pressure from the interior of the cooking container through the gap/passage to the exterior, the pressure controlling portion restricting the evacuation of pressure relative to the pressure accumulating portion after the breakable seal is broken.

According to another embodiment, the seal has a first width along a substantial length of the edge and wherein the breakable seal has a second width along another length of the edge, the first width being greater than the second width.

According to another embodiment, the other length is smaller than the substantial length.

According to another embodiment, the second width is between 1/32 inches and 1/8 inches.

According to another embodiment, the first width is between 3/8 inches and 1/2 inches and the second width is between 1/32 inches and 1/8 inches.

According to another embodiment, the breakable seal longitudinally extends from the seal, wherein the breakable seal and the seal form a continuous sealing element.

According to another embodiment, the cooking container is a pouch or a bag made of a microwaveable film.

According to another embodiment, a first edge of a first microwaveable film and a second edge of a second microwavable film form the edge separating the interior from the exterior of the cooking container.

According to another embodiment, the cooking container comprises a tray having an opening and a microwaveable film for covering the opening.

According to another embodiment, a first edge of a first microwaveable film and a flange of the tray form the edge separating the interior from the exterior of the cooking container.

According to another embodiment, the seal and the breakable seal comprise a heat-sealable polyester film.

According to another embodiment, the pressure controlling portion comprises a series of holes in the cooking container between the breakable seal and the exterior of the cooking container and on the controlling portion.

According to another embodiment, the other length is greater than 1/2 in.

According to another embodiment, the seal is in two parts and the breakable seal is located so as to join the two parts of the seal before it is broken.

According to another embodiment, the seal has an inside boundary and wherein the breakable seal is located 3/16 inches to 1/4 inches from the inside boundary.

According to another embodiment, the cooking container comprising: more than one seals; and more than one valves extending from a respective one seal of the more than one seals.

According to another embodiment, the pressure accumulating portion comprises a pressure accumulating portion section having a first length and wherein the pressure controlling portion comprises a pressure controlling portion section having a second length, the first length of the pressure accumulating portion section being longer than the second length of the pressure controlling portion section.

According to another embodiment, there is provided a cooking container for cooking foodstuff comprising: an edge having a seal separating the interior from the exterior of the cooking container; a steam valve formed in the seal, the steam valve comprising: a pressure accumulating portion; and a breakable seal in contact with the pressure accumulating portion; whereby the breakable seal is breakable under an increase in pressure in the pressure accumulating portion during cooking thereby forming a gap/passage having a set predetermined size in the seal and permitting controlled evacuation of pressure in the cooking container through the gap/passage.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments described herein, there is disclosed a cooking container for foodstuff, such as fresh vegetables, which assists in optimizing quality and shelf-life of the perishable food product. This is achieved by the bag, pouch or the lid film containing micro perforations having a diameter of between 40-80 microns that effectively control the gas exchange of O2 and CO2 which leads to extended product life.

The cooking container for foodstuff including the perishable food product within may be positioned for steam cooking within a microwave oven. Other cooking techniques as contemplate by those of ordinary skill in the art may be employed for cooking the perishable food product within the cooking container for foodstuff.

It is also contemplated that the cooking container for foodstuff may be used for storing and distributing perishable meat products.

The novel steam vent described herein serves at least two purposes, namely 1) maintain a controlled atmosphere prior to cooking inside the cooking container in the case of contents being fresh vegetables, and 2) allow the buildup of steam to a certain pressure inside the cooking container before venting which optimizes cooking quality of the food.

Figure 1:
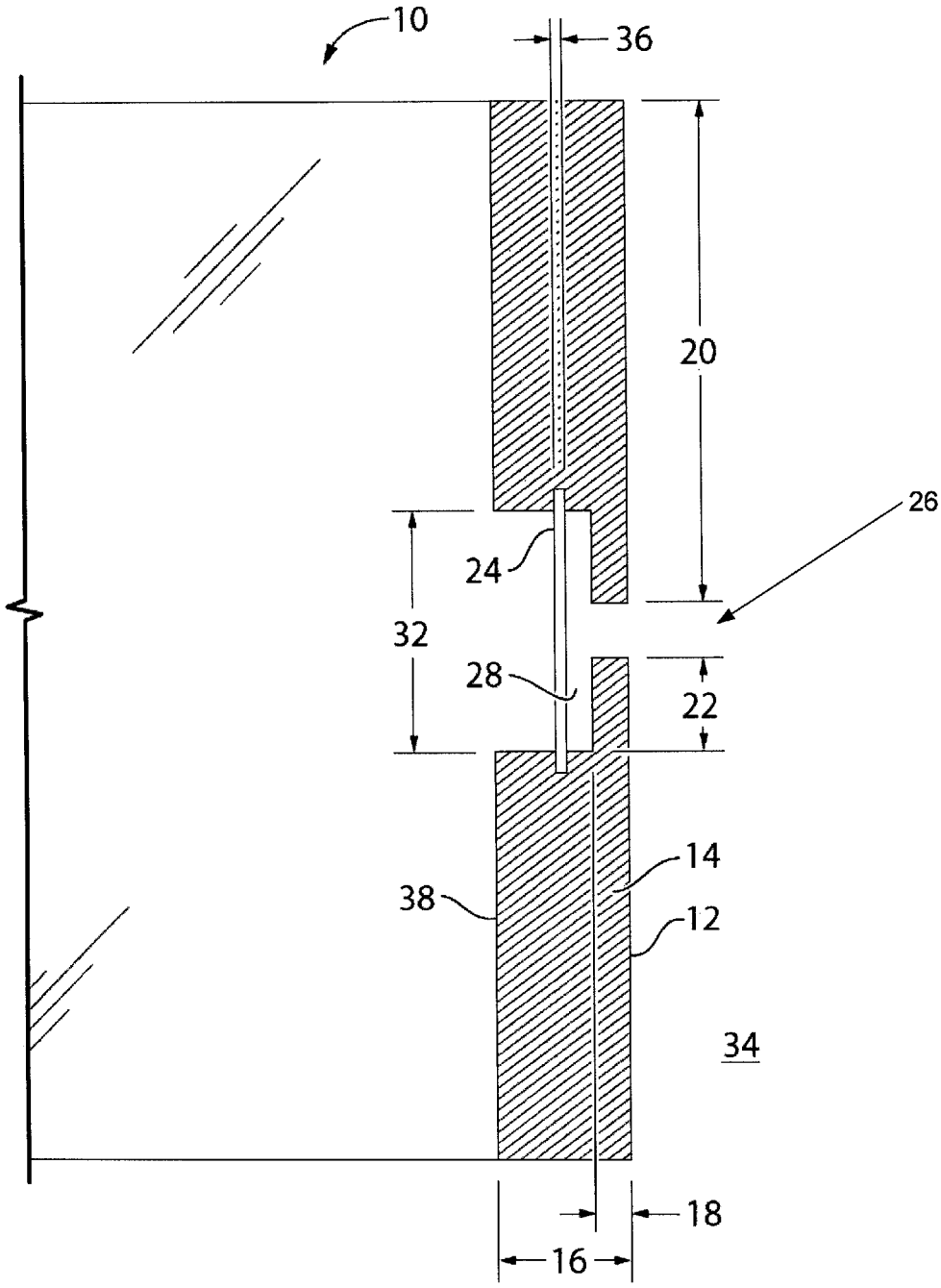
FIG. 1 illustrates a breakable seal of an edge of a cooking container for foodstuff according to an embodiment.

Referring now to the drawings, and more particularly to FIG. 1, there is illustrated a breakable seal 24 of an edge 12 of a cooking container 10 for foodstuff according to an embodiment. In another embodiment, the breakable seal is positioned in a back seal (not shown) instead of the edge 12.

More specifically, the cooking container 10 for foodstuff is in the form of a pouch made of a microwaveable heat-sealable polyester film. The cooking container 10 first includes an edge 12 and an edge seal 14 along the edge 12. The edge seal 14 of the cooking container 10 is having a first width 16 along a substantial length 20 of the edge 12 and a second width 18 along another length 22 of the edge 12 in which the other length 22 is being shorter than the substantial length 20 and the first width 16 is being wider than the second width 18.

The cooking container 10 for foodstuff also includes a breakable seal 24, which is breakable under an increase in pressure inside the pouch during microwave cooking. The cooking container 10 for foodstuff further includes an opening 26, which permits the evacuation of pressure inside the pouch after the breakable seal 24 is broken. The breakable seal 24 of the cooking container 10 for foodstuff closes off the opening 26 from the exterior.

There is also shown that the opening 26 of the cooking container 10 for foodstuff is located between the breakable seal 24 and the outside 34 of the cooking container 10. As shown on FIG. 1, the opening 26 of the food container comprises a gap 28 in a portion of the edge 12 having the second width 18. As steam pressure builds during cooking, it pushes against the gap 28 separating the film and allowing the steam to vent through the gap 28 at a controlled rate.

Also, for the cooking container 10 for foodstuff, the first width 16 is between ¼ inches and 1 inch and the second width 18 is between 1/16 inches and ½ inches. The breakable seal 24 of the cooking container 10 for foodstuff has a width 36 between 1/32 inches and ⅛ inches. Moreover, the breakable seal 24 of the cooking container 10 has a length 32 of more than ¼ inches. The opening being smaller than the length of the length of breakable seal. According to an embodiment, the opening 26 has a width (vertically on FIG. 1) between, 1/16 inches to ½ inches. These dimensions can vary greatly since they are adapted to the quantity and weight of the foodstuff meant to be stored and cooked in the cooking container.

Additionally, the first width 16 is in two parts and the breakable seal 24 is located so as to join the two parts before it is broken. Still shown on FIG. 1, the edge seal 14 of the cooking container 10 for foodstuff is having the first width 16 having an inside boundary 38 and the breakable seal 24 is located about 3/16 inches to about ¼ inches from the inside boundary 38.

Figure 2:
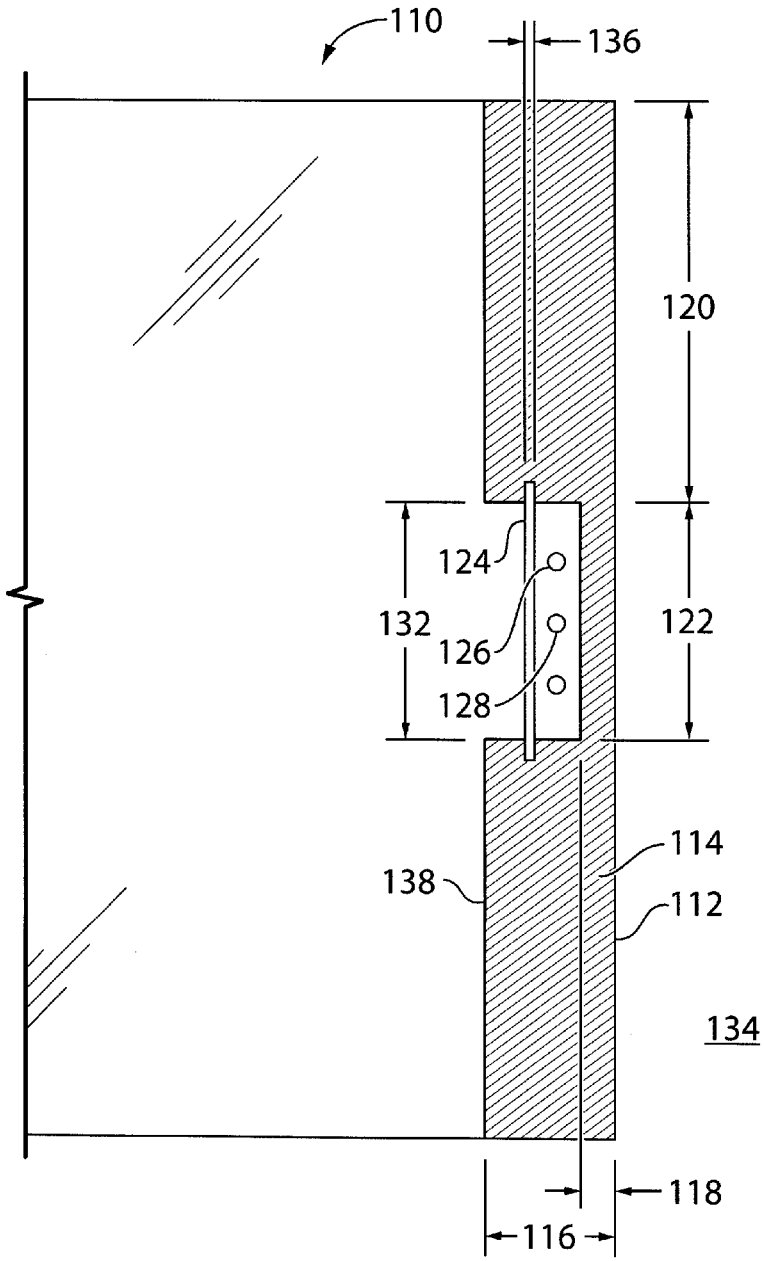
FIG. 2 illustrates a breakable seal of an edge of a cooking container for foodstuff according to another embodiment.

Now referring to FIG. 2, there is shown another embodiment of a breakable seal 124 of an edge 112 of a cooking container 110 for foodstuff.

More specifically, the cooking container 110 for foodstuff is in the form of a pouch made of a microwaveable heat-sealable polyester film. The cooking container 110 first includes an edge 112 and an edge seal 114 along the edge 112. The edge seal 114 of the cooking container 110 is having a first width 116 along a substantial length 120 of the edge 112 and a second width 118 along another length 122 of the edge 112 in which the other length 122 is being shorter than the substantial length 120 and the first width 116 is being wider than the second width 118.

The cooking container 110 for foodstuff also includes a breakable seal 124, which is breakable under an increase in pressure inside the pouch during microwave cooking. The cooking container 110 for foodstuff further includes an opening 126, which permits the evacuation of pressure inside the pouch after the breakable seal 124 is broken. The breakable seal 124 of the cooking container 110 for foodstuff closes off the opening 126 from the exterior.

There is also shown that the opening 126 of the cooking container 10 for foodstuff is located between the breakable seal 124 and the outside of the cooking container. As shown on FIG. 2, the opening 126 of the food container comprises a series of holes 128 in a portion of the edge 112 having the second width 118. As steam pressure builds during cooking, it pushes against the series of holes 128 separating the film and allowing the steam to vent through the series of holes 128 at a controlled rate. The series of holes 128 may be positioned as close of the back of the seal as possible. It is also to be noted that the series of holes may be defined by any other suitable shapes and may not necessarily be limited to circular shapes.

Also, for the cooking container 110 for foodstuff, the first width is between ⅜ inches and ½ inches and the second width 118 is between ⅛ inches and ¼ inches. The breakable seal 124 of the cooking container 110 for foodstuff has a width 136 between 1/32 inches and ⅛ inches. Moreover, the breakable seal 124 of the cooking container 110 has a length 132 of more than ½ inches.

Additionally, the edge seal 114 has the first width 116 in two sections and the breakable seal 124 is located so as to join the two sections before it is broken. Still shown on FIG. 2, the edge seal 114 of the cooking container 110 for foodstuff is having the first width 116 having an inside boundary 138 and the breakable seal 124 is located about 3/16 inches to about ¼ inches from the inside boundary 138.

It is to be noted that the cooking containers 10 and 110 may include more than an edge seal for providing the steam to vent through the gap 28 or the series of holes 128 at a controlled rate. Also, by adjusting the width of the opening in the seal edge, the quantity of steam escaping from the cooking container can be controlled, thereby maintaining a positive pressure inside the bag which again optimizes the quality of the cooking.

Figure 3:
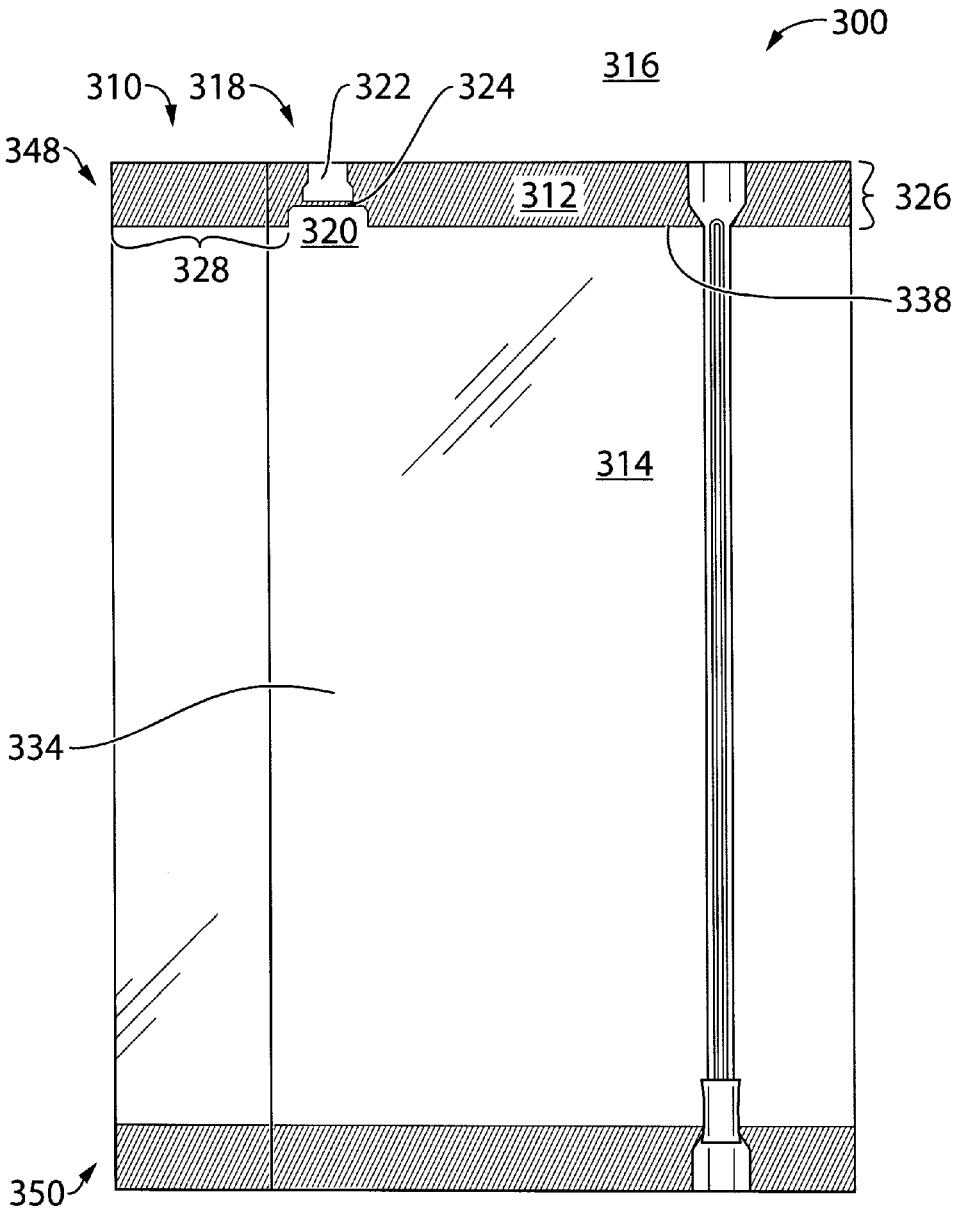
FIG. 3 illustrates a valve on an edge of a cooking container for foodstuff according to an embodiment.
Figure 4:
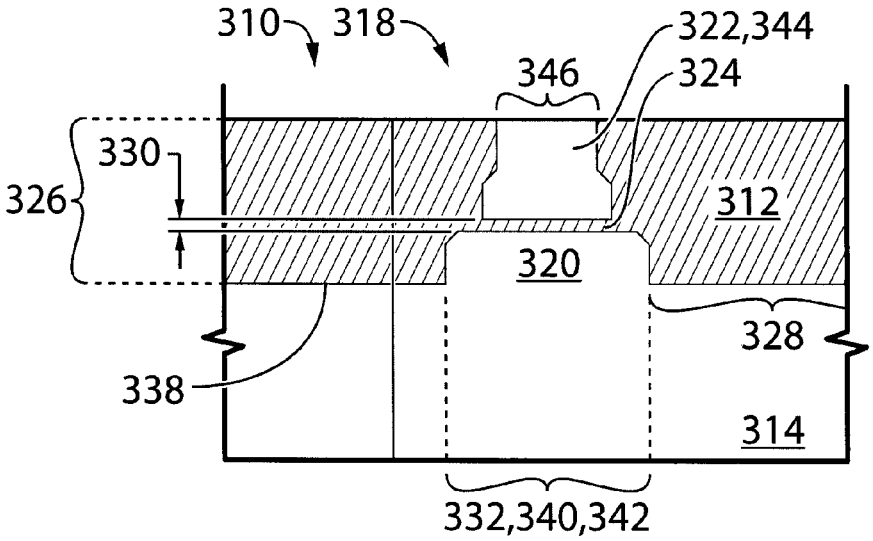
FIG. 4 illustrates the valve of FIG. 3.

According to another embodiment and referring now to FIGS. 3 and 4, there is shown cooking container 300 for cooking foodstuff. The cooking container 300 comprises an edge 310 having a seal 312 separating the interior 314 from the exterior 316 of the cooking container 300. The cooking container 300 also comprises a steam valve 318 formed in the seal 312. The steam valve 318 of the cooking container 300 comprises a pressure accumulating portion 320, a pressure controlling portion 322 and a breakable seal 324. The breakable seal 324 is between the pressure accumulating portion 320 and the pressure controlling portion 322.

In the cooking container 300, the breakable seal 324 is breakable under an increase in pressure in the pressure accumulating portion 320 during cooking thereby forming a gap, or a passage, in the seal 312. This permits controlled evacuation of pressure from the interior 314 of the cooking container 300 through the gap, or passage, to the exterior 316. Also, in the embodiment shown here, the pressure controlling portion 322 restricts the evacuation of pressure relative to the pressure accumulating portion 320 after the breakable seal 324 is broken. As will be shown later, the pressure controlling portion 322 can be the same width as the pressure accumulating portion 320. In yet other embodiment, the pressure controlling portion 322 is integrated with the pressure accumulating portion 320. The pressure controlling function is simply provided by the set predetermined size of the passage in the seal 312.

According to an embodiment, the seal 312 of the cooking container 300 has a first width 326 along a substantial length 328 of the edge 310 and the breakable seal 324 of the cooking container 300 has a second width 330 along another length 332 of the edge 310. It is to be noted that the first width 326 is greater than the second width 330 according to this embodiment. According to an embodiment, the other length 332 of the edge 310 of the cooking container 300 is smaller than the substantial length 328 of the edge 310 of the cooking container 300.

According to an embodiment, the breakable seal 324 of the cooking container 300 longitudinally extends from the seal 312, in which the breakable seal 324 and the seal 312 form a continuous sealing element. It is also to be noted that the seal 312 and the breakable seal 324 may be made of either different parts or materials.

According to another embodiment, the cooking container 300 may be a pouch or a bag made of a microwaveable film 334. The pouch or bag may comprise an edge 310 having a seal 312 separating the interior 314 from the exterior 316 of the pouch or bag. The pouch or bag may also comprise a steam valve 318 formed in the seal 312. The steam valve 318 of the pouch or bag may comprise a pressure accumulating portion 320, a pressure controlling portion 322 and a breakable seal 324. The breakable seal 324 is between the pressure accumulating portion 320 and the pressure controlling portion 322.

In the pouch or bag, the breakable seal 324 is breakable under an increase in pressure in the pressure accumulating portion 320 during cooking thereby forming a gap, or a passage, in the seal 312. This permits controlled evacuation of pressure in the pouch or bag through the gap, or passage. Also, the pressure controlling portion 322 is narrower than the pressure accumulating portion 320 after the breakable seal is broken. According to this embodiment, a first edge 348 of a first microwaveable film and a second edge 350 of a second microwavable film form the edge 310 separating the interior 314 from the exterior 316 of the pouch or the bag.

According to an embodiment, the seal 312 and the breakable seal 324 of the cooking container 300 comprise a heat-sealable polyester film.

According to an embodiment, the cooking container 300 further comprises an opening located between the breakable seal 324 and the outside of the cooking container 300. The opening may be in the seal 312. Moreover, the pressure controlling portion 322 may comprise a series of holes in the cooking container 300 between the breakable seal 324 and the exterior 316 of the cooking container 300 and on the pressure controlling portion 322, as illustrated in FIG. 2.

According to an embodiment, the breakable seal 324 has second width 330 that may be between 1/32 inches and 1/16 inches. The first width 326 may be between 3/8 inches and 1/2 inches while the second width 330 may be between 1/8 inches and 1/4 inches.

According to an embodiment, the other length 332 of the cooking container 300 may be greater than 1/2 in.

According another embodiment, the seal 312 of the cooking container 300 may be in two parts and the breakable seal 324 may be located so as to join the two parts of the seal 312 before it is broken.

According to a further embodiment, the seal 312 of the cooking container 300 may have an inside boundary 338 and the breakable seal 324 may be located from about 3/16 inches to about 1/4 inches from the inside boundary 338.

According to an embodiment, the cooking container 300 as described above may comprise more than one seal 312; and more than one steam valve 318 extending from a respective one seal 312 of the more than one seal 312. For instance, the cooking container 300 may comprise two edges 310 and two, three or four steam valves 318 disposed on each edge 310.

According to an embodiment, the pressure accumulating portion 320 of the. cooking container 300 comprises a pressure accumulating portion section 340 having a first length 342 and the pressure controlling portion 322 of the cooking container 300 comprises a pressure controlling portion section 344 having a second length 346, in which the first length 342 of the pressure accumulating portion section 340 is being longer than the second length 346 of the pressure controlling portion section 344.

Figure 6:
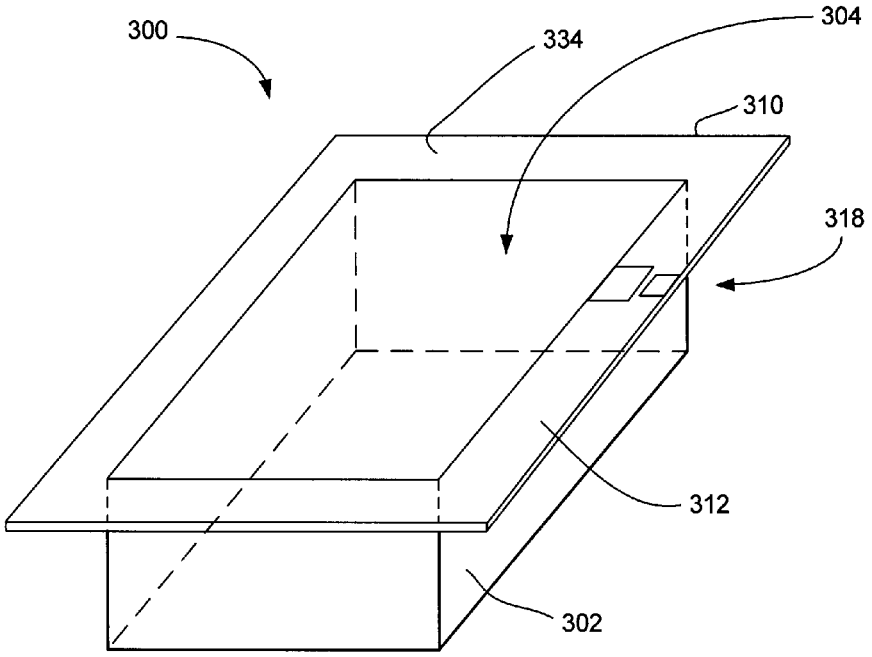
FIG. 6 illustrates a valve on an edge of a tray according to an embodiment.

According to a further embodiment, and now referring to FIG. 6, the cooking container 300 may be a tray 302 having an opening 304 and a microwaveable film 334 for covering the opening. The tray 302 comprises a microwaveable film 334 that comprises an edge 310 having a seal 312 separating the interior 314 from the exterior 316 of the tray 302 comprising a microwaveable film 334. The tray comprises a microwaveable film may also comprise a steam valve 318 formed in the seal 312. The steam valve 318 of the tray 302 functions in the same way as the one described earlier and will not be further described.

According to another embodiment, and referring to FIGS. 3, 4 and 6, there is provided a cooking container 300 for cooking foodstuff. The cooking container 10 comprises an edge 310. The edge 310 has a seal 312 separating the interior 314 from the exterior 316 of the cooking container 300. The cooking container 300 also includes a steam valve 318 formed in the seal 312. The steam valve 318 comprises a pressure accumulating portion 320 and a breakable seal 324. The breakable seal 324 is in contact with the pressure accumulating portion 320, in where the breakable seal 324 is breakable under an increase in pressure in the pressure accumulating portion 320 during cooking, thereby forming a gap/passage having a set predetermined size in the seal 312 and permitting controlled evacuation of pressure in the cooking container 300 through the gap/passage.

Figure 5:
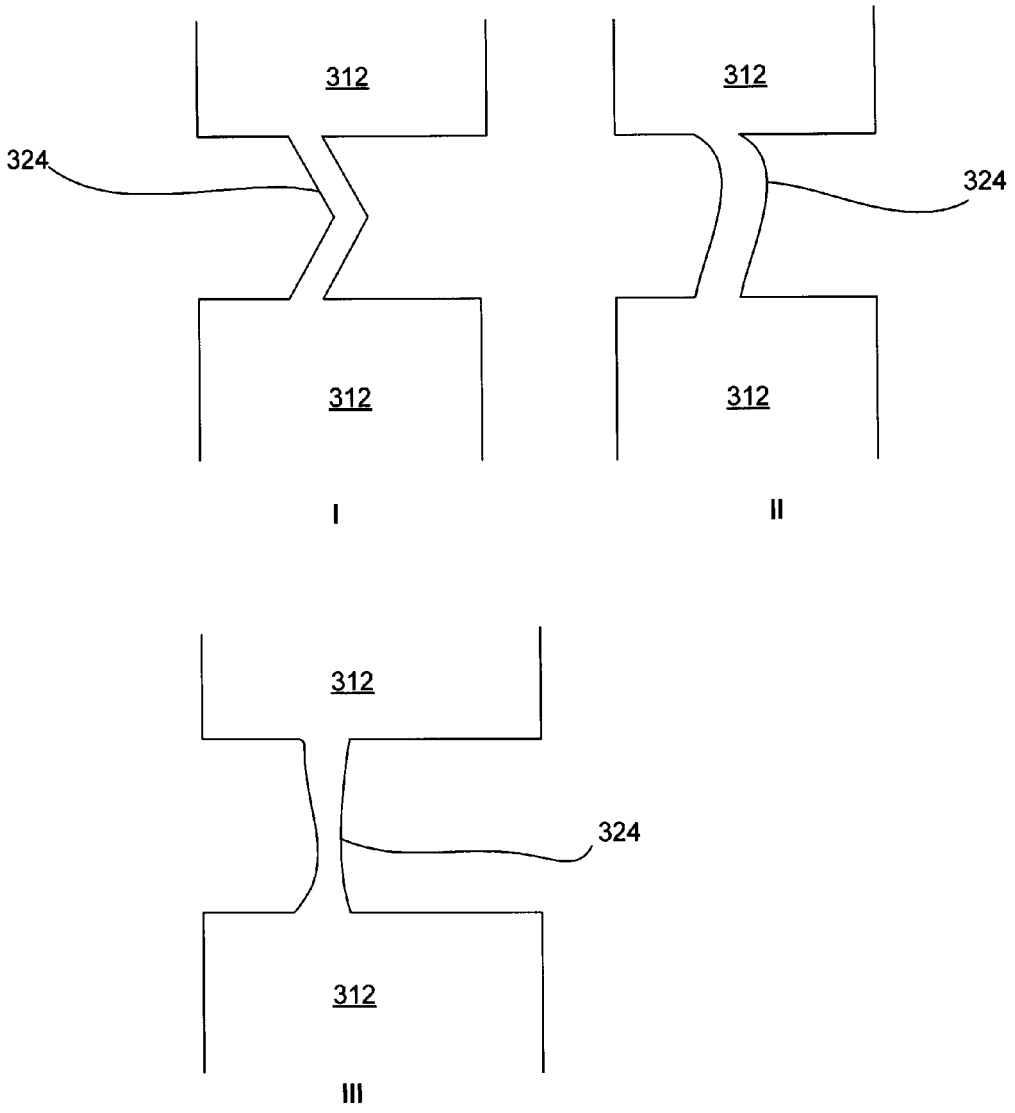
FIG. 5 illustrates different configurations for the breakable seal of the steam valve.

It is also to be noted that the breakable seal 324 of the steam valve 318 of the cooking container 300 may adopt different shapes and configurations, as shown in FIG. 5. However, an optimal shape/configuration of the breakable seal 324 of the steam valve 318 is illustrated in FIGS. 3 and 4.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A cooking container for cooking foodstuff, comprising:

an edge having a seal extending in a longitudinal direction along the edge, the seal separating the interior from the exterior of the cooking container;

a steam valve formed in the seal, the steam valve comprising:

a pressure accumulating portion extending into the seal from the interior of the cooking container in a direction transverse to the longitudinal direction, wherein a length of the pressure accumulating portion is substantially smaller than a length of the seal in the longitudinal direction;

a pressure controlling portion, wherein a length of the pressure controlling portion is substantially smaller than the length of the seal in the longitudinal direction; and a breakable seal between the pressure accumulating portion and the pressure controlling portion, wherein the pressure accumulating portion, the breakable seal, and the pressure controlling portion are arranged in a line transversely to the longitudinal direction; and whereby the breakable seal is breakable under an increase in pressure in the pressure accumulating portion during cooking thereby forming a gap/passage in the seal and permitting controlled evacuation of pressure from the interior of the cooking container through the gap/passage to the exterior, the pressure controlling portion restricting the evacuation of pressure relative to the pressure accumulating portion after the breakable seal is broken.

2. The cooking container of claim 1, wherein the seal has a first width along a substantial length of the edge and wherein the breakable seal has a second width along another length of the edge, the first width being greater than the second width.

3. The cooking container of claim 2, wherein the other length is smaller than the substantial length.

4. The cooking container of claim 2, wherein the second width is between 1/32 inches and 1/8 inches.

5. The cooking container of claim 2, wherein the first width is between 3/8 inches and 1/2 inches and the second width is between 1/32 inches and 1/8 inches.

6. The cooking container of claim 1, wherein the breakable seal longitudinally extends from the seal, wherein the breakable seal and the seal form a continuous sealing element.

7. The cooking container of claim 1, wherein the cooking container is a pouch or a bag made of a microwaveable film.

8. The cooking container of claim 7, wherein a first edge of a first microwaveable film and a second edge of a second microwavable film form the edge separating the interior from the exterior of the cooking container.

9. The cooking container of claim 1, wherein the cooking container comprises a tray having an opening and a microwaveable film for covering the opening.

10. The cooking container of claim 9, wherein a first edge of a first microwaveable film and a flange of the tray form the edge separating the interior from the exterior of the cooking container.

11. The cooking container of claim 1, wherein the seal and the breakable seal comprise a heat-sealable polyester film.

12. The cooking container of claim 1, wherein the pressure controlling portion comprises a series of holes between the breakable seal and the exterior of the cooking container.

13. The cooking container of claim 2, wherein the other length is greater than 1/2 in.

14. The cooking container of claim 1, wherein the seal is in two parts and the breakable seal is located so as to join the two parts of the seal before it is broken.

15. The cooking container of claim 1, wherein the seal has an inside boundary and wherein the breakable seal is located 3/16 inches to 1/4 inches from the inside boundary.

16. The cooking container of claim 1, the cooking container comprising:

more than one seals; and more than one valves extending from a respective one seal of the more than one seals.

17. The cooking container of claim 1, wherein the pressure accumulating portion comprises a pressure accumulating portion section having a first length and wherein the pressure controlling portion comprises a pressure controlling portion section having a second length, the first length of the pressure accumulating portion section being longer than the second length of the pressure controlling portion section.

* * * * *